United States Patent [19]

Nyland

[11] 4,392,433

[45] Jul. 12, 1983

[54] RAILWAY MAINTENANCE MACHINE

[75] Inventor: Clifford A. Nyland, Prior Lake, Minn.

[73] Assignee: Railroad Service, Inc., Lakeville, Minn.

[21] Appl. No.: 176,016

[22] Filed: Aug. 7, 1980

[51] Int. Cl.[3] ..... E01B 29/10

[52] U.S. Cl. ..... 104/9; 104/6

[58] Field of Search ..... 104/1, 2, 3, 6, 7 R, 104/8, 9; 105/177

[56] References Cited

U.S. PATENT DOCUMENTS

| | | | |
|---|---|---|---|
| 2,781,002 | 2/1957 | Talboys | 105/177 |
| 2,989,926 | 6/1961 | Sublett et al. | 105/177 |
| 3,210,046 | 10/1965 | Krause, Jr. | 104/9 |
| 3,306,232 | 2/1967 | Holley | 104/6 |
| 3,314,374 | 4/1967 | Moorehead, Jr. et al. | 104/9 |
| 3,330,219 | 7/1967 | Plasser et al. | 104/2 |
| 3,537,400 | 11/1970 | Taylor | 104/9 |
| 3,604,358 | 9/1971 | Plasser et al. | 104/6 |
| 3,613,598 | 10/1971 | Plasser et al. | 104/6 |
| 3,654,868 | 4/1972 | Plasser et al. | 104/2 |
| 3,675,580 | 7/1972 | Kershaw | 104/9 |
| 3,698,324 | 10/1972 | Peppin et al. | 104/9 |
| 3,766,859 | 10/1973 | Byrne | 104/9 |
| 3,780,664 | 12/1973 | Holley et al. | 104/9 |
| 3,976,142 | 8/1976 | Plasser et al. | 104/2 |
| 4,004,524 | 1/1977 | Scheuchzer et al. | 104/2 |
| 4,046,077 | 9/1977 | Theurer et al. | 104/6 |
| 4,094,249 | 6/1978 | Theurer et al. | 104/6 |
| 4,108,076 | 8/1978 | Knape | 104/2 |
| 4,152,989 | 5/1979 | Theurer et al. | 104/2 |
| 4,160,418 | 7/1979 | Theurer | 104/2 |

*Primary Examiner*—Richard A. Bertsch

*Attorney, Agent, or Firm*—Merchant & Gould

[57] ABSTRACT

A railway maintenance machine including a carriage or body portion (22) and a boom (38) extending therefrom and functioning to remove railroad ties (88) from a railway bed and insert new ties in place thereof, is disclosed. Latch arms (90), mounted to the underside of the vehicle body (22) can be provided to lock rail portions of the track (86) to the body (22) so that, when the body (22) is jacked up by means provided for this purpose, the tracks (86) will be elvated also. The boom (38) mounts a working element (40) which includes angularly spaced removing and inserting arms (98, 100) which are rotatable to effect removal and insertion of ties (88).

5 Claims, 9 Drawing Figures

FIG. 1
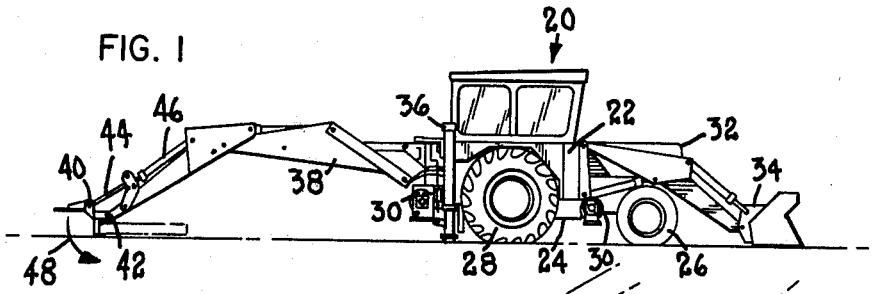
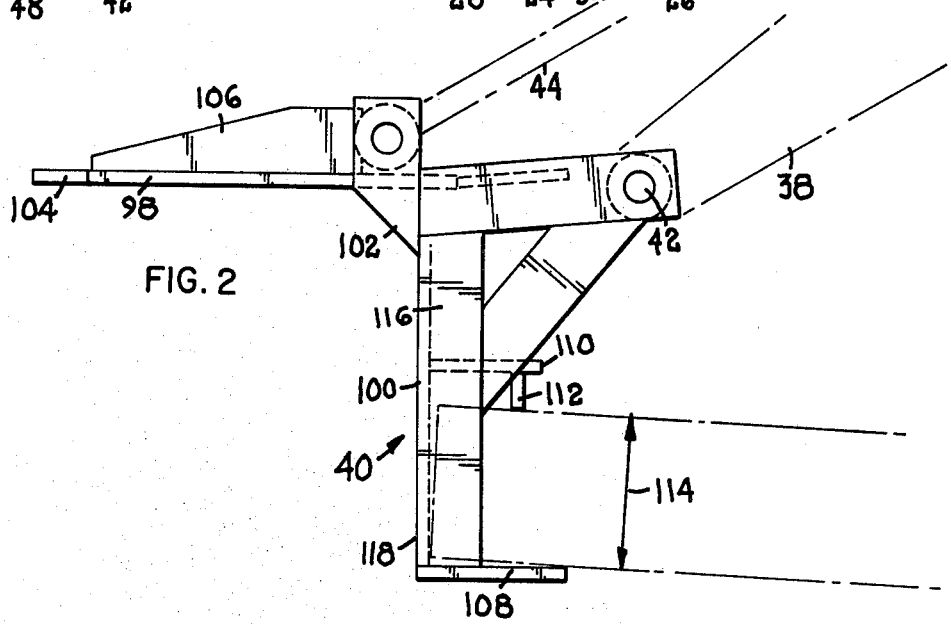
FIG. 2
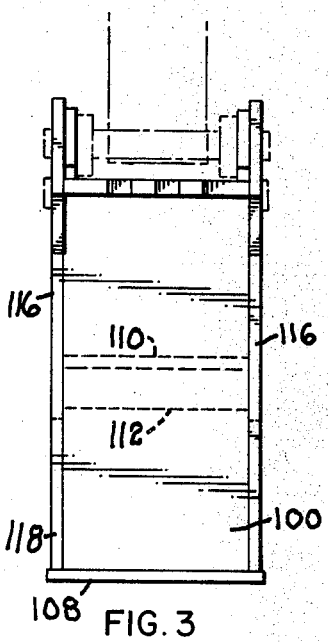
FIG. 3
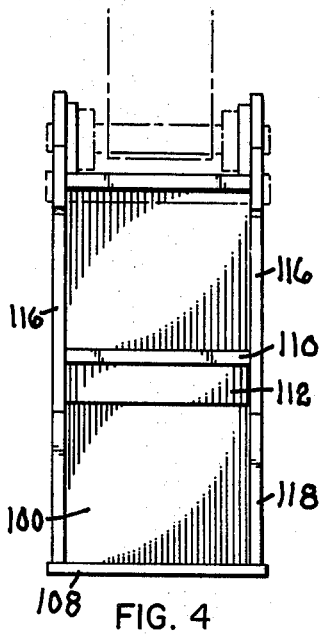
FIG. 4

FIG. 7
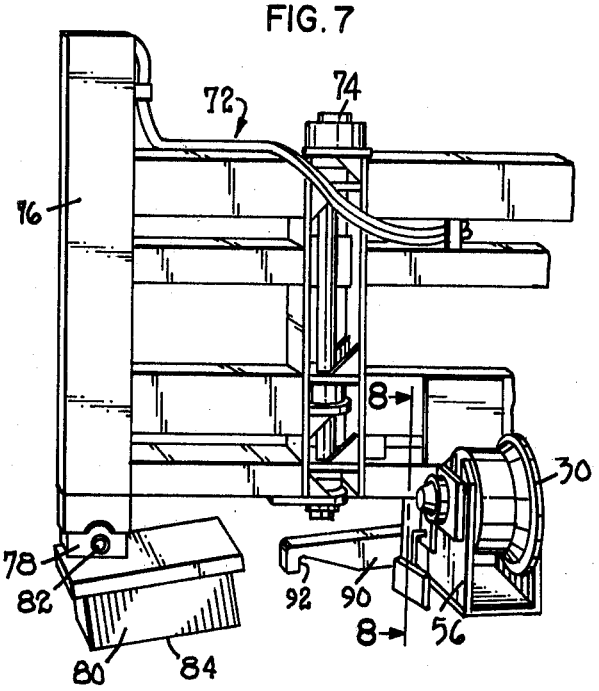
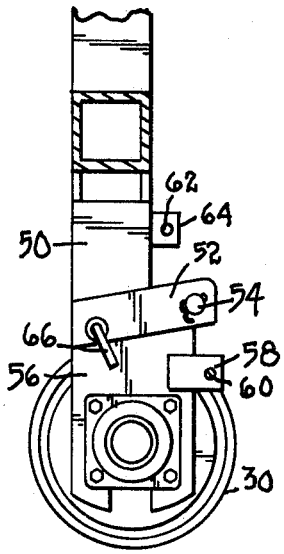
FIG. 9
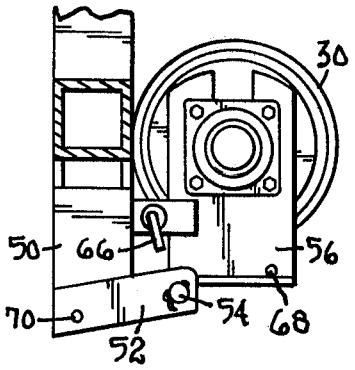
FIG. 8

RAILWAY MAINTENANCE MACHINE

TECHNICAL FIELD

The invention of this application relates generally to equipment for use in maintaining railroad tracks. More specifically, it deals with a vehicle which can be mounted on railroad tracks and moved along the tracks for maintenance and repair work at various points. The vehicle includes apparatus for lifting the rail portion of a track segment and other apparatus for removing old ties supporting the rails and inserting new ties in place of the ones removed.

BACKGROUND OF THE PRIOR ART

Vehicles for maintaining railroad tracks including the rail portions of the tracks and the railroad ties supporting the rails are known in the prior art and have been in use since the inception of the railroad industry. The problems in maintaining these components of the tracks were recognized early, and various attempts have been made to provide devices which facilitate repairs or refurbishment including the replacement of deteriorated rail supporting ties. In replacing ties, the operation is facilitated if the downward pressure exerted on them by the rail portions is eliminated by raising the track first. Structures for accomplishing this function are also known in the art, and U.S. Pat. No. 3,604,358 issued to Franz Plasser et al is one fairly recent illustration of a device designed to accomplish this function. The structure of that reference accomplishes raising of the rails by use of an extension vehicle which runs over the ground. The rails are diverted up over this extension vehicle so that, as the vehicle is moved, that portion of the track for which ties are being replaced is elevated and the ties thereunder are more accessible.

One drawback of this structure is that the rails are brought into sliding engagement with the extension vehicle. As a result, damage can be inflicted upon the rails or, at a minimum, some measure of abrasion will be applied to the rail surfaces as they slide across portions of the extension vehicle.

There are other problems existent with structures known in the prior art. Frequently, the vehicle used for effecting repairs and tie replacement is normally configured for movement over roads, but having special mounting apparatus to position the vehicle on a railroad track when the repair and tie replacement is to be effected. When, however, the vehicle is to be positioned on a length of track for work thereon, means must be provided for stabilizing the vehicle during its operation. Many structures utilize hydraulic or pneumatic lifters to elevate the wheels mounting the vehicle to a height above the tracks. It is desirable that these lifters be spaced apart laterally at a substantial distance to increase the base area of the vehicle and, in turn, the stability. It is essential to safe operation of the vehicle that these lifters be spaced apart far enough so that ground engaging portions of the lifters will be straddling the ties. If the ground engaging portions rested on the ties, stability might be sacrificed since the ground engaging portions might slide off of the irregular surface created by the ties.

The fact that these stabilizers need be spaced at a minimum distance somewhat greater than the length of the tie creates problems when the vehicle is being operated on a road or highway. State legislation frequently provides that any load being transported must not exceed a maximum width, and, even when this maximum width is not exceeded, special equipment must be used to warn that the width of the load exceeds a second width corresponding to the normal width of an automobile or similar vehicle.

One other problem which has remained uncured by the various devices designed to accomplish the railway maintenance function relates to the actual removal of the ties from beneath the elevated rails. Many of these structures utilize a hydraulically actuated boom for pushing the ties from their positions in the railway bed. This pushing function is accomplished by use of an arm having a single tine. The arm is brought to bear against the tie so that the tine digs into the wood of which the tie is made. The arm is then moved to push the tie from its location in the bed. Frequently, however, the force exerted by the arm will not be applied along the axis of the tie, and the tie will rotate about the pivot point provided by the single tine. A smooth and complete displacement from its location on the bed can, thereby, be hindered.

It is these problems existent in the prior art to which the invention of this application is directed. The invention provides an improved railway maintenance machine to solve these problems.

BRIEF SUMMARY OF THE INVENTION

The present invention is a railway maintenance vehicle which includes a carriage, typically providing a control station for operation of the vehicle. The carriage can be positioned over a segment of railroad track, and, when it is in this position, the railway track disposed immediately below the carriage can be locked thereto. With the track so locked to the carriage, means are provided for vertically jacking the body to a position elevated above the height at which the body is normally disposed. Since the track is locked to the body, it is elevated along with the body. The invention further includes structure mounted to, and extending from, the body and controllable to remove old railroad ties positioned on the railway bed beneath the elevated rails and to replace those removed with new ties.

Locking the track rails to the body can be accomplished by providing a pair of latch mechanisms to the underside of the body, which mechanisms can be brought in engagement with the rails so that a shoulder formed in the free end of the latch mechanism can engage an undersurface on the rails. Vertical jacking of the body will, therefore, in turn, effect elevation of the rails with the body.

In certain embodiments, the jacking means can include a pair of frames, each of said pair pivotally mounted to the body on opposite sides thereof for pivoting about a generally vertical axis between various positions intermediate a first orientation in which they are rigged in extending generally parallel to the intended direction of movement of the vehicle and a second position in which they are rigged out in an orientation generally transverse to the intended direction of travel of the vehicle. Each frame has attached thereto a ground engagement member at a point along the horizontal dimension of the frame. The ground engagement member is attached to the body or carriage by the frame for vertical movement relative to the carriage. Typically, the ground engagement members would be attached to the frames at points on the frame outermost from the carriage when the frames are in their "rigged out" positions. Such a jacking means construction provides the invention with a maximum measure of stability given the dimensions of the frames yet allows the vehicle to have some measure of lateral compactness for travel down a road or highway.

The tool for effecting removal and insertion of railroad ties beneath the track section can include a boom mounted to the carriage. In one embodiment, the boom has a working member mounted at its end opposite the end to which it is attached to the carriage. The working member is attached to the boom for pivoting about a generally horizontal axis and includes two arms which are angularly spaced with respect to the axis and disposed for movement about the axis. A first arm, or tie removing arm, includes, in this embodiment, a plurality of tie engaging elements which can comprise tines extending longitudinally from a free end of the arm. The other arm or tie inserting arm can include a lip mounted proximate the free end and extending generally perpendicular to this arm. Rotational movement can be imparted to the working element to pivot the element such that when the tie engaging elements engage a tie, the tie can be pushed out of its position in the railroad bed. The tie inserting arm can, thereafter, be brought to bear against one end of a new tie, and, as the working element is pivoted in a reverse direction, the new tie will be pulled back onto the bed to replace the removed tie.

In order to prevent undesired engagement of one of the arms with the ground as the other arm is being operated to accomplish its function, the arms can be spaced angularly from one another at an angle of more than ninety degrees.

The invention of this application is thus an improved railway maintenance machine for removing old railroad ties and inserting new ones in place of those removed. Specific advantages of the invention will become apparent with reference to the accompanying detailed description of the invention, claims, and drawings.

BRIEF DESCRIPTION OF THE DRAWINGS

FIG. 1 is a side elevational view of the invention in accordance with the present application;

FIG. 2 is an enlarged side elevational view of the working member portion of the structure of FIG. 1;

FIG. 3 is a view of the structure illustrated in FIG. 2 as viewed from left to right;

FIG. 4 is a view of the structure illustrated in FIG. 2 as viewed from right to left;

FIG. 7 is an enlarged view in perspective illustrating the outrigger frame assembly, the track latching assembly, and a track engaging wheel in its retracted position;

FIG. 8 is an enlarged side elevational view of the track engaging wheel in its retracted position; and FIG. 9 is an enlarged side elevational view of the track engaging wheel in its lowered position.

DESCRIPTION OF THE PREFERRED EMBODIMENT

Figure 5:
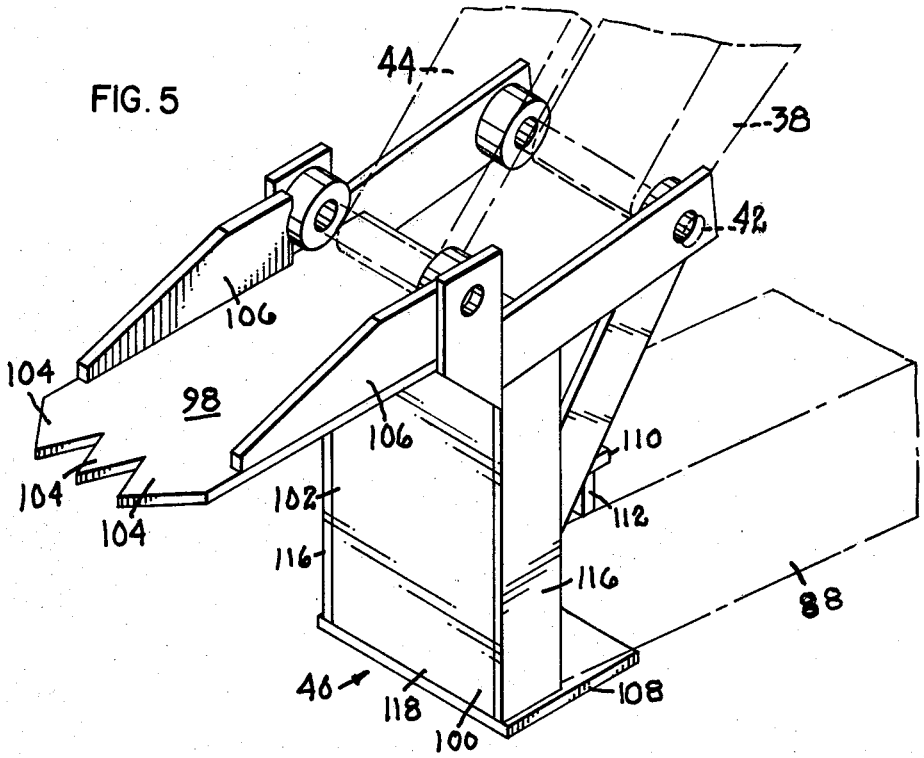
FIG. 5 is a view in perspective of the structure shown in FIG. 2.

Referring to the drawings wherein like reference numerals denote like elements throughout the several views, FIG. 1 illustrates a structure in accordance with the preferred embodiment of the present invention. A vehicle, generally designated 20, includes a carriage or body 22 which is mounted for horizontal movement. The carriage 22 is supported by a chassis 24 which includes front ground engaging wheels 26 and rear ground engaging wheels 28, which together comprise a first wheel means, and a plurality of track engaging wheels 30, which comprise a second wheel means. The vehicle 20 has, mounted at its front end 32, a boom/-bucket assembly 34. This assembly 34 does not comprise part of the invention of this application, but is illustrated as mounted to the vehicle 20 in FIG. 1 to highlight the versatility of the structure of the present invention.

The vehicle 20 has mounted, at its rear end 36, a hydraulically actuated boom 38. The boom 38 is mounted for horizontal movement about a generally vertically oriented axis of pivoting so that it can be disposed transverse to the intended direction of movement of the vehicle 20. The boom 38 has a working element 40 mounted at its second or free end. The working element 40 is mounted for pivoting about a pin 42 defining a generally horizontally oriented axis.

The working element 40 is made to pivot about this generally horizontal axis by means of an elongated element or shaft 44 which extends longitudinally from its first end mounted to the piston of a hydraulic cylinder 46, to its second end which is pivotally mounted at a location on the working element 40. This shaft 44 extends generally parallel to the boom 38 and is disposed for longitudinal movement, as imparted by the hydraulic cylinder 46, relative to the boom 38. As the shaft 44 is extended, the working element 40 will be made to pivot about the generally horizontal axis in a direction counterclockwise as shown in FIG. 1 by arrow 48. When the shaft 44 is retracted, the working element 40 will be made to pivot in a clockwise direction.

Referring now to FIGS. 7–9, one of the track engaging wheels 30 is highlighted. FIGS. 7 and 8 show the wheel 30 in its retracted or raised position. The wheel assembly includes a generally vertical stanchion 50 having a member 52 oriented generally transverse thereto and at the bottom thereof. At an end of the transverse member 52 away from the vertical stanchion 50 is a pivot pin 54 extending through the transverse member 52. This pin 54 is inserted through a hole proximate the end of the transverse member 52 which registers with a hole in a strut 56 to which the wheel 30 is journaled. The strut 56 includes a tab 58 having a hole 60 formed therethrough which can be made to register with a hole 62 formed in a second tab 64 extending from the vertical stanchion 50. With these holes 60, 62 in alignment, a removable pin 66 can be inserted therethrough to maintain the strut mounted wheel 30 in its retracted position.

When the vehicle 20 is in a position such that it is desired that the track engaging wheels 30 be lowered, the removable pin 66 can be withdrawn from the aligned holes 60, 62 and the strut 56 permitted to rotate to a second position wherein the wheels 30 can engage railroad tracks. A hole 68 is provided in the strut 56 to register with another hole 70 in the stanchion 50 so that the wheel 30 can be locked in this second position. When the wheel 30 is in its lowered position, the removable locking pin 66 can be inserted through these aligned holes 68, 70.

Figure 6:
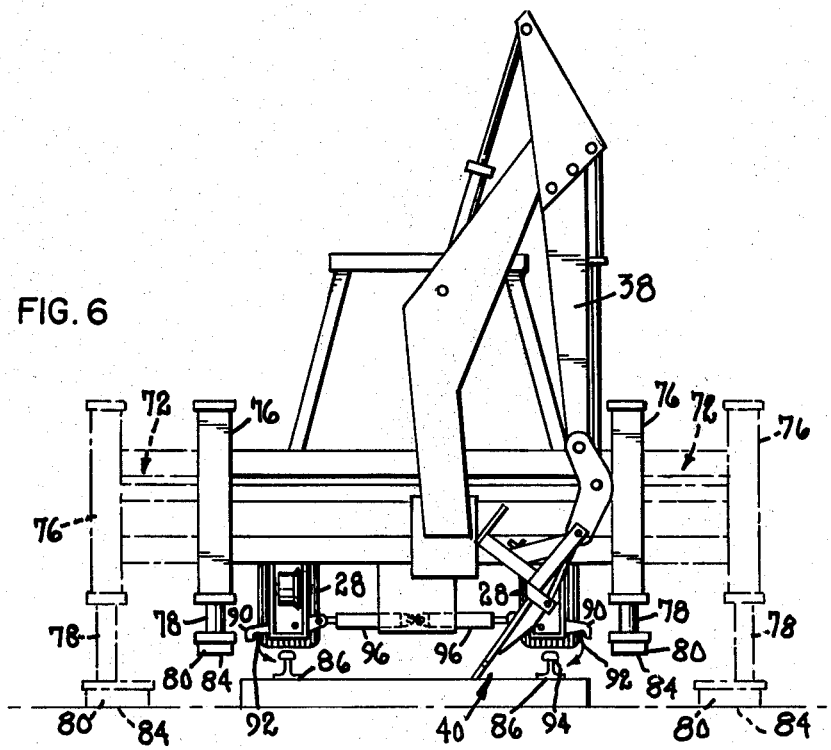
FIG. 6 is a front view showing the various positions of the jacking structure.

With reference to FIGS. 6 and 7, those figures illustrate apparatus which can be used both (1) to assist the vehicle 20 in transitioning between a configuration wherein the ground engaging wheels 26, 28 are utilized for transporting the vehicle 20 over ground, and another configuration in which the track engaging wheels 30 are utilized for transporting the vehicle 20 along a stretch of railroad track, and (2) to provide a measure of stability to the vehicle 20 during the railroad tie replacement operation which will be described hereinafter. Frames 72 are pivotally mounted to the carriage or body 22 by means of a generally vertically extending pin 74 defining an axis of pivoting. Means, not shown, are provided to cause the frames 72 to rotate about this pin 74. Hydraulic control means are contemplated as one method by which pivoting of the frames 72 could be actuated. Such control means can, additionally, serve as means to lock the frames in either positions in which they are rigged out to provide a broader support base or a position wherein they are aligned along the sides of the vehicle body 22.

The frames 72 are shown to include a hydraulic cylinder 76 having an actuation member 78 extending downwardly therefrom. The actuation member 78 is mounted to a piston within the cylinder 76. At the bottom end of the actuation member 78, a ground engagement block 80 is pivotally mounted. The block 80 is mounted for rotation about a generally horizontal pin 82 so that adjustments can be automatically made to the contour of the ground engaged. The block 80 includes an abrasive surface 84 in order to preclude movement of the vehicle 20 when it is elevated by the jacking structure.

As previously indicated, the jack can be used to assist in positioning the vehicle 20 onto the railroad tracks 86 with its track engagement wheels 30 engaging the tracks 86. This is accomplished by, first, driving the vehicle 20 onto the tracks 86 with the track engaging wheels 30 in the retracted position. The frames 72 can, thereafter, be rigged out and the jacking means actuated to raise the vehicle 20 vertically so that the first wheel means is elevated to clear the tracks 86 and to a height so that the second wheel means can be pivoted downward, as previously described, without interference from the rails 86. During this operation, the bucket 34 or another implement mounted on the front end 32 of the vehicle 20 can act as a fulcrum. After the track engaging wheels 30 are lowered and locked into these extended positions, the jacking means can lower the vehicle 20 so that it rests on, and is supported by, the track engaging wheels 30. With the vehicle 20 so mounted on the rails 86, the frames 72 can be rigged in while the vehicle 20 is propelled along the tracks 86.

The jacking means can also serve a stabilizing function during railroad tie removal and replacement operations. When the ties 88 supporting a particular section of track need be replaced, the maintenance vehicle 20 is positioned over that section of the track. The jacking structure is actuated, with the frames 72 in the rigged out positions, to elevate the vehicle 20 above the particular section of the track. The ground engagement blocks 80 are, with the frames 72 in these positions, disposed at a distance significantly farther from one another than are wheels on opposite sides of the vehicle 20. Consequently, the vehicle 20 will be more stable when the boom 38 is operated to remove ties 88 and replace them with new ties.

As best seen in FIG. 6, the jacking means can serve another function related to the elevation of the vehicle 20. Means can be provided for locking the tracks 86 to the vehicle 20 so that they will be raised when the vehicle is raised. A pair of latch arms 90 is provided to effect this locking. Each latch arm 90 includes a free end having a shoulder 92 defined therein. The latch arm 90 is pivotally mounted to the underside of the carriage 22 so that the free end can be swung down so that the shoulder 92 formed therein is made to engage a generally horizontal undersurface 94 on the track rail 86. The latching arms 90 can be actuated by hydraulic cylinders 96 to effect this pivoting motion and to lock the latch arms 90 in positions engaging the rails 86. As the vehicle 20 and rails 86 are elevated, weight is taken off the ties 88 supporting the rails 86, and the ties 88 can be more easily slid out from a position in the railway bed.

The working element 40, as illustrated in FIGS. 2 and 5, includes removing and inserting arms 98, 100 angularly spaced from one another and intersecting proximate the arms' first ends to form a generally L-shaped structure 102. The removing arm 98 includes a plurality of tie engaging elements positioned at its second end. The tie engaging elements are so constructed that, when engaging a railroad tie 88, they will not slip relative to the tie 88. FIG. 5 shows these elements as a series of three linearly aligned tines 104 extending longitudinally from the second end of the removing arm 98. The removing arm 98 can further include strongbacks 106 mounted along the arms 98 to provide increased strength.

The inserting arm 100 includes a lip 108 which functions to raise one end of a new tie 88 which is to be inserted to replace a removed tie, as the end of the tie 88 is engaged by the arm 100. The lip 108 extends generally transversely to the arm 100 and is inserted beneath the end of the tie 88 to effect lifting action as the working element 40 is rotated.

The lip can cooperate with an upper grasping element 110 having an engagement edge 112 spaced from the lip 108 at a distance slightly greater than the diameter 114 of a tie 88. As the working element 40 is pivoted, and the lip 108 effects a lifting action upon the tie 88, the engagement edge 112 will preclude rotation of the tie 88 sufficient to cause it to fall from the lip 108. As with the removing arm 98, the inserting arm 100 can also include strongbacks 116 provided for strength. With the inserting arm 100, the strongbacks 116 can function to limit lateral motion of the end of the tie 88 and assist in retaining the end of the tie 88 in a box 118 formed by the strongbacks 116, the lip 108, and the upper grasping element 110.

Operation of the working element 40 will now be described with reference to FIG. 6. Although that figure does not show the tracks 86 in a raised position, it is assumed, for purposes of further description, that the tracks 86 would be raised prior to effecting tie 88 removal. The tines 104 of the removing arm 98 are brought to bear upon the tie 88, and sufficient pressure is imparted to the tines 104 so that they dig into the wood from which the tie 88 is made. Pivoting the working element 40 about its axis of rotation will cause the tie 88 to be propelled laterally out from under the tracks 86. This may involve disengaging of the tines 104 and reengaging them at another portion of the tie 88 until the tie 88 is substantially slid out from under both of the rails 86.

As the working element 40 is pivoted in a counterclockwise direction as seen in FIG. 6, it will be seen that the inserting arm 100 rotates toward the ground. It has been found that it is advantageous to angularly space the inserting arm 100 at least ninety degrees from the removing arm 98 so that the inserting arm 100 will not engage the ground during the tie removing function. Although angles of as little as eighty degrees between the arms 98, 100 have been found to be acceptable, an angle of ninety-five degrees is optimally provided so that frequent disengagement and reengagement of the tines 104 is not necessary.

Conversely, it is undesirable to have too great of an angle between the arms 98, 100 since such a construction would cause interference between the inserting arm 100 and the boom 38 during the tie removing function. It is, therefore, desirable to limit the angular spacing of the arms 98, 100 to a maximum of 135 degrees.

It will be apparent to those of skill in the art that, after the tie 88 is removed, the inserting arm 100 should be in a position so that it can engage a new tie at one end disposed away from the tracks to pull the replacement tie back into the position vacated by the old tie. Operation of the removing arm 98 to push old ties out and the inserting arm 100 to pull new ties into position causes the working element 40 to be given a back and forth rocking motion during its operation. The angle of rotation of the working element 40 necessary for effective operation can, thereby, be limited to approximately 180 degrees.

Although the railway maintenance machine of this application has been described above in terms of specific embodiments and preferred constructions, it will be, of course, understood that the invention is defined in the appended claims, and many alternatives and modifications within the spirit and scope of the invention as defined by these claims will occur to those of skill in the art.

What is claimed is:

1. A device for removing old railroad ties from beneath an elevated length of track and inserting new ties in place of those removed, comprising:

(a) a working member including (i) a removing arm having first and second ends and a plurality of tie engagement elements at said second end, said removing arm disposed for movement generally about said first end; and (ii) an inserting arm having first and second ends and a tie lifting lip mounted at said second end of said inserting arm generally perpendicular thereto, said inserting arm fixed relative to said removing arm and spaced angularly therefrom for movement generally about its said first end; and (b) means for imparting rotational movement to said working member with said arms moving generally about their said first ends.

2. The device of claim 1 wherein said inserting arm is spaced angularly from said removing arm between 80 degrees and 135 degrees.

3. The device of claim 2 wherein said inserting arm is spaced angularly from said removing arm substantially 95 degrees.

4. The device of claim 3 wherein said lip extends from said inserting arm in a direction away from said removing arm.

5. The device of claim 1 wherein said tie engagement elements comprise tines extending longitudinally from said second end of said removing arm.

* * * * *